US007993213B1

(12) United States Patent
D'Eath

(10) Patent No.: US 7,993,213 B1
(45) Date of Patent: Aug. 9, 2011

(54) GOLF CLUB

(75) Inventor: Roger A. D'Eath, Venice, FL (US)

(73) Assignee: Craig A. Drinko, Palmetto, FL (US)

( * ) Notice: Subject to any disclaimer, the term of this patent is extended or adjusted under 35 U.S.C. 154(b) by 0 days.

(21) Appl. No.: 12/868,225

(22) Filed: Aug. 25, 2010

(51) Int. Cl.
*A63B 53/02* (2006.01)

(52) U.S. Cl. ..... 473/288; 473/307; 473/340

(58) Field of Classification Search ..... 473/288, 473/307, 340–341, 309, 313–314
See application file for complete search history.

(56) References Cited

U.S. PATENT DOCUMENTS

| | | | | |
|---|---|---|---|---|
| 5,046,740 | A | 9/1991 | D'Eath | |
| 5,722,140 | A * | 3/1998 | Marshall | |
| 5,863,257 | A * | 1/1999 | Busnardo | 473/246 |
| 5,890,969 | A * | 4/1999 | Bechler | 473/255 |
| 6,595,872 | B2 * | 7/2003 | Yagley et al. | 473/371 |
| 7,125,341 | B1 | 10/2006 | D'Eath | |
| D586,413 | S | 2/2009 | D'Eath | |
| 7,485,051 | B2 * | 2/2009 | Richard, Jr. | 473/314 |
| 2006/0014591 | A1 * | 1/2006 | Engdahl | 473/340 |
| 2006/0030420 | A1 * | 2/2006 | Roake | 473/251 |
| 2006/0234810 | A1 * | 10/2006 | Chiodo et al. | 473/340 |
| 2008/0045355 | A1 * | 2/2008 | Sevon | 473/340 |
| 2010/0167831 | A1 * | 7/2010 | Smith et al. | 473/255 |
| 2010/0173720 | A1 * | 7/2010 | Kim | 473/252 |

FOREIGN PATENT DOCUMENTS

JP 07303716 A * 11/1995

* cited by examiner

*Primary Examiner* — Stephen L. Blau
(74) *Attorney, Agent, or Firm* — Charles J Prescott

(57) ABSTRACT

A golf club including a club head having an upright golf ball striking face and an elongated upright cavity formed into an upper surface of the club head and being positioned in close proximity to the striking face. A separate hosel sized for close fitting insertion into the cavity has a height greater than the depth of the cavity so that the hosel extends above the cavity after mechanical securement of the hosel within the cavity for viewing prominence and interchangeability. The hosel also has a diagonally upwardly extending hole for receiving and lockably supporting a distal lower end of the club shaft, the axis of the hole selectively oriented at an acute angle rearwardly with respect to a bottom surface of the club head to establish a lie angle of the golf club.

10 Claims, 4 Drawing Sheets

GOLF CLUB

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the field of golf club equipment and design, and more particularly to the golf club in combination with an interchangeable hosel for quickly and economically interchanging club lie angles and club heads for various types of golf play and players.

2. Description of Related Art

The sport of golf commands perhaps the largest body of equipment technology available today for any sport or leisure activity. The range of golf club equipment, golf balls and various accessories appears to be endless and ever growing. It is suggested that more leisure dollars are spent on golf equipment per player than any other sport activity.

In fact, the undersigned has acquired two U.S. patents to add to this body of golf equipment technology. In U.S. Pat. No. 5,046,740, D'Eath teaches a golf putter having a substantially t-shaped putter club head having a perpendicularly disposed elongated body housing a plurality of weighted balls arranged in diametrically abutting relation for improved energy transfer into the golf ball when struck. In U.S. Pat. No. 7,125,341, D'Eath teaches a golf club putter having a uniquely arranged and configured multi-material density club head for improved balance and energy delivery into a putted golf ball. D'Eath has also invented a unique design taught in U.S. D586,413.

Despite the ever increasing cost of each equipment item in the field of golf, nonetheless each golf club is typically uniquely configured both with respect to club head design, shape and weight, and also with respect to the lie angle between the club shaft and the bottom surface of the club head so that, should a golfer wish to vary the parameters of the golf club, new equipment bearing those redesigned or reconfigured features is typically purchased, the previous equipment being discarded or passed on to other players.

However, occasionally, a design emerges for golf club equipment which facilitates some degree of interchangeability which renders parameter alteration of the golf club easier and less expensive. That is the case with the present invention on several levels. Not only does the present disclosure afford interchangeability of hosels to effect quick and easy alteration of the club lie angle, but the same club shaft may be utilized on a variety of golf club heads such as putters, irons, and woods club heads utilizing the same hosel and shaft and associated gripping area of the shaft. For example, should the golfer wish to alter the lie angle of a special golf club putter, the head is removed, another hosel interchanged with the current hosel and, in increments of 1° or 2°, the lie angle of shaft to club head bottom surface is easily alterable utilizing simple, easily available tools.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a golf club including a club head having an upright golf ball striking face and an elongated upright cavity formed into an upper surface of the club head and being positioned in close proximity adjacent to the striking face. A separate hosel sized for close fitting insertion into the cavity has a height greater than the depth of the cavity so that the hosel extends above the cavity after mechanical securement of the hosel within the cavity for viewing prominence and removability. The hosel also has a diagonally upwardly extending hole for receiving and lockably supporting a distal lower end of the club shaft, the axis of the hole selectively oriented at an acute angle sloping rearwardly with respect to a bottom surface of the club head to establish a lie angle of the golf club.

It is therefore an object of this invention to provide a golf club with easily interchangeable golf club lie angles and club head configurations.

Still another object of this invention is to provide a golf club with interchangeability of components and geometry utilizing readily available, simple hand tool equipment to effect interchangeability.

Yet another object of this invention is to provide a prominent visual guide for better "sweet spot" alignment of the club head to the golf ball.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

DETAILED DESCRIPTION OF THE INVENTION

Figure 3:
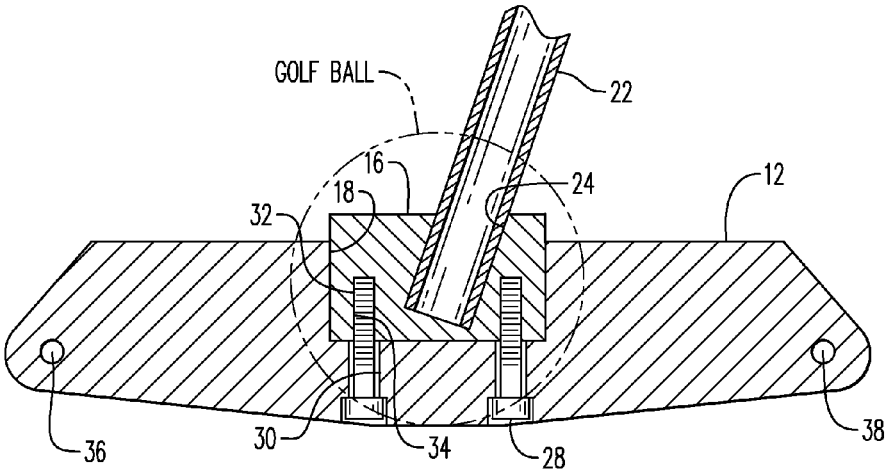
FIG. 3 is section view in the direction of arrows 3-3 in FIG. 1.
Figure 4:
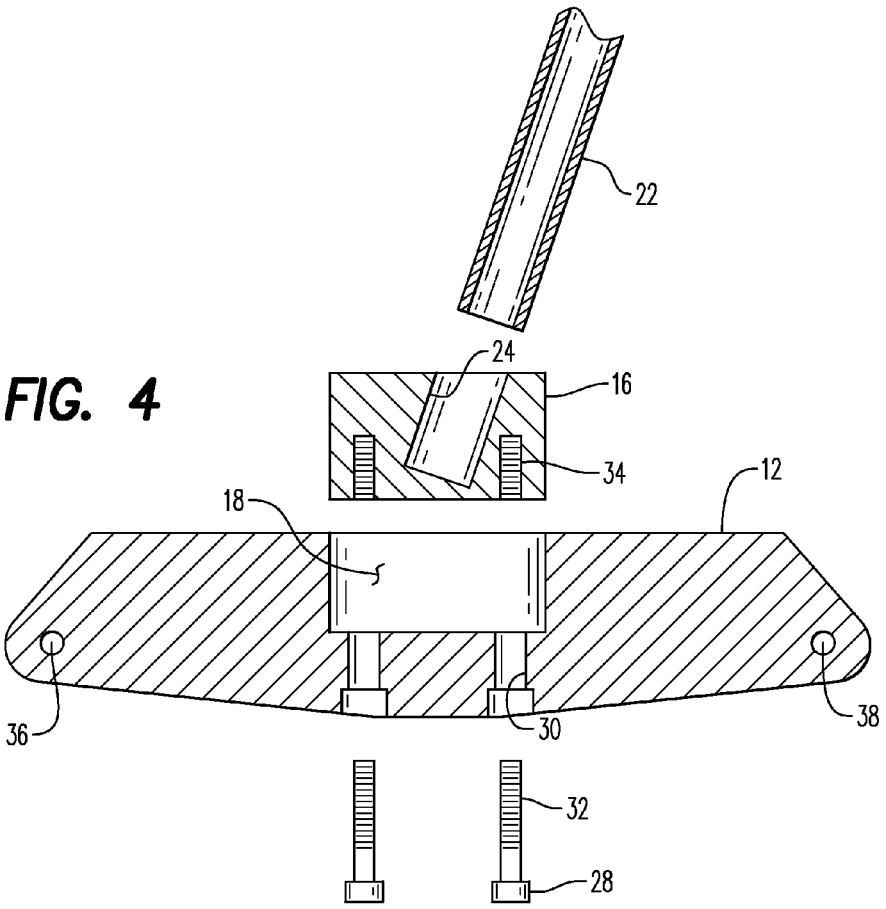
FIG. 4 is an exploded view of FIG. 3.

Referring now to the drawings, and firstly to FIGS. 1 to 4, the preferred embodiment of the invention is there shown generally at numeral 10 and includes a uniquely configured half mag wheel putter club head 12 having a ball striking face 14 and simulated tire area 26 spaced around a simulated wheel hub 20 of a mag wheel of a race car. This golf putter design is disclosed in U.S. D586,413 in conjunction with a conventionally secured golf club shaft. A golf club shaft 22 having a lower cylindrical shaft portion best seen in section in FIGS. 3 and 4, is held within a cylindrical bore 24 formed into a metal hosel 16. This hosel 16 is tightly fitted into a mating racetrack-shaped cavity 18 formed downwardly into the hub area 20 of the golf club head 12, the cavity 18 being closely spaced adjacent to the ball striking surface 14 and evenly spaced fore and aft over the length of the club head 12. The club head 12 is formed of components which are held together by mechanical threaded cap screws 40 fitted into mating cap screw cavities 36 and 38 and threadably engageable into each end of the simulated tire portion 26.

The hosel 16 is rigidly secured against the bottom of cavity 18 by threaded cap screws 28 which are threadably engageable at 32 into threaded apertures 34 formed into the bottom of the hosel 16 as best seen in FIG. 4. The cap screws 28 matably engage into cap screw holes 30 spaced apart and extending upwardly from the bottom surface of the golf club head 12 into cavity 18, again as best seen in FIG. 4. Thus, the hosel 16, although tightly fitted into cavity 18 and secured in place by cap screws 28 to effect a virtually solid interface with the club head 12, nonetheless the hosel 16 is easily removable and replaceable for the purposes described herebelow.

The lower distal end of the golf club shaft 22 is tightly fitted into a mating cylindrical hole 24 formed extending downwardly into the hosel 16. To enhance the retention of the shaft 22 within the cylindrical hole 24, an epoxy bond may be added which is easily releasable at a later date for interchangeability by the addition of heat to the hosel 16 when removed from the golf club head 12 in the manner previously described.

Note in FIG. 3 that the hosel 16, having a height greater than a depth of the cavity 18, extends above the upper surface of the club head 12 to provide prominent visibility and ease in gripability to effect interchangeability. Moreover, the length of the hosel is similar to a diameter of a golf ball shown in phantom. By locating the cavity 18 centrally along the length of the club face 14, it is easier for a golfer to visually align the center of the club head, called the "sweet spot" to the golf ball during each strike.

Figure 5:
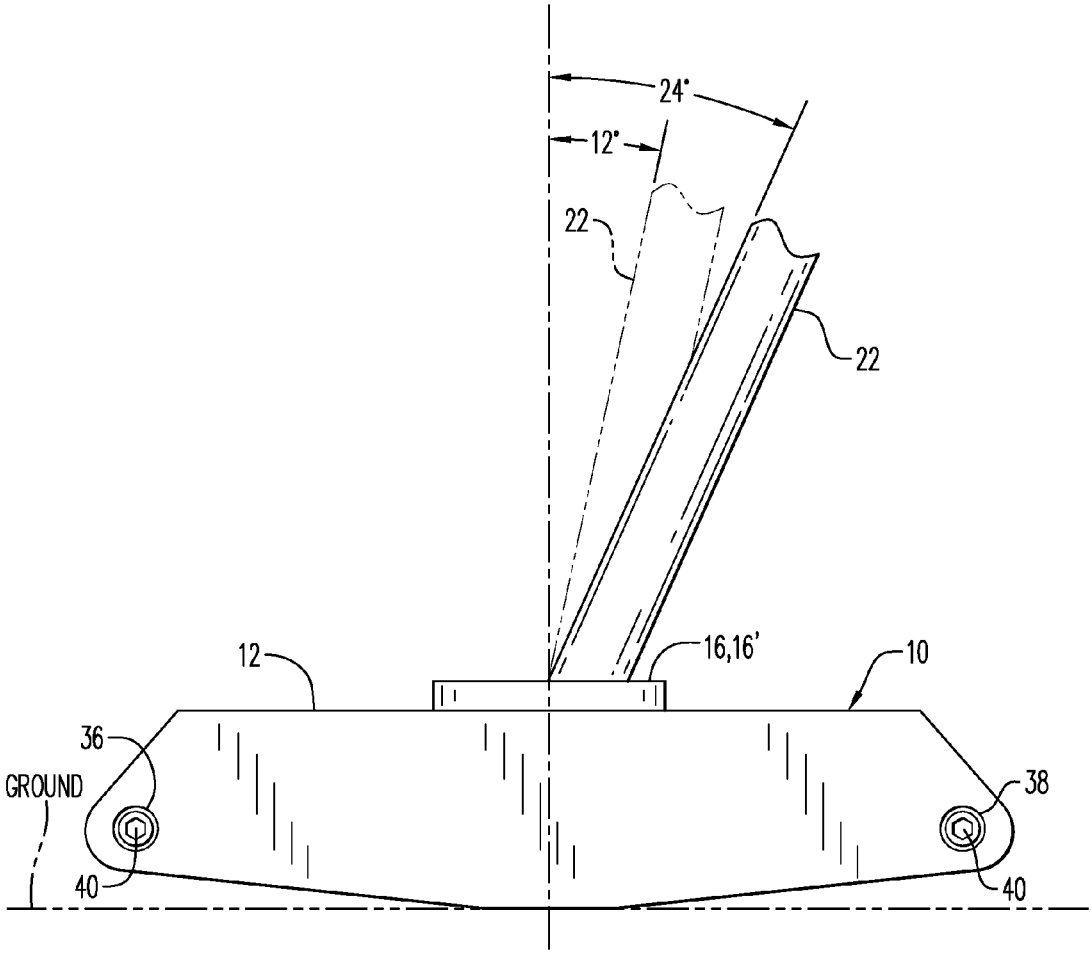
FIG. 5 is an elevation view of the club face and shaft of FIG. 1 depicting the interchangeably of the hosel to achieve variable lie angles of the club shaft with respect to the bottom surface of the club head.

Referring now to FIG. 5, an important aspect of the invention is there shown. Utilizing the same golf club head 12, a variety of hosels 16, 16' may be installed into the mating cavity 18 of the club head 12 as previously described. Each of the hosels 16, 16' include the cylindrical hole 24 best seen in FIG. 4 which is oriented diagonally rearwardly with respect to the lower surface of the club head 12 when properly positioned against ground. Thus, the longitudinal axis of the shaft 22 is oriented in accordance with the angle of the shaft hole 24 within the hosel 16, 16'. A typical range of shaft lie angles achieved by selective hosels 16, 16' is preferably in the range of 12° to 24° in 1" to 2" increments. The lie angle of the shaft 22 to ground is thus easily interchangeable by the selection of an appropriate hosel 16, 16'.

Figure 1:
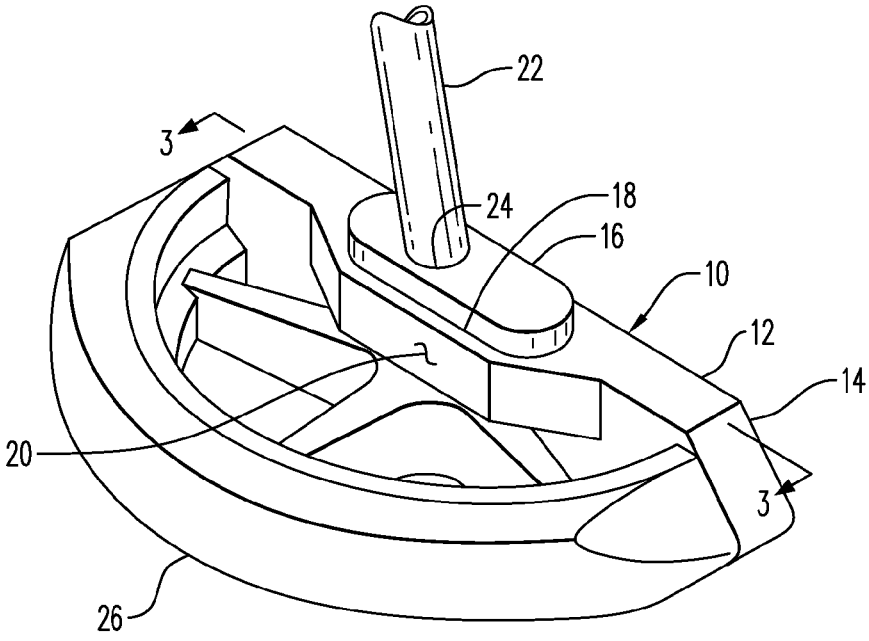
FIG. 1 is a perspective view of a putter club head embodiment of the invention.
Figure 2:
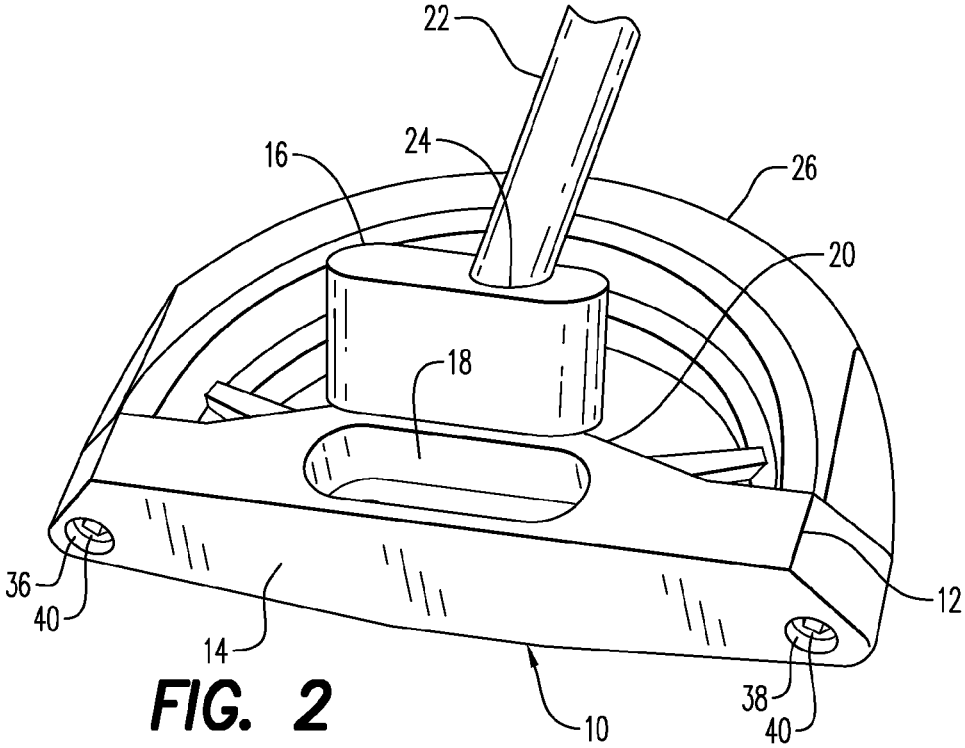
FIG. 2 is another perspective view of FIG. 1.
Figure 6:
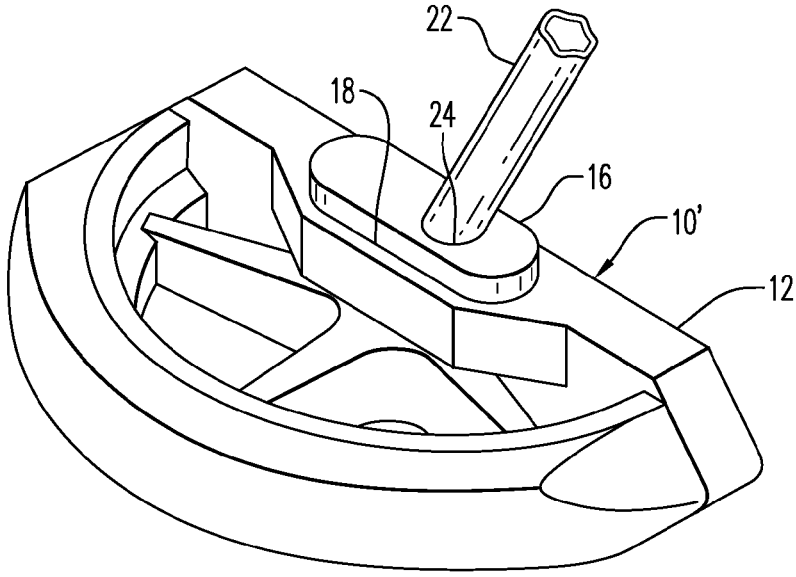
FIG. 6 is an alternate embodiment of the invention shown in FIG. 1 for left-handed golfers.

Referring now to FIG. 6, a left-hand version of the embodiment of the invention of FIG. 1 is there shown generally at numeral 10'. Because the club head 12 has been designed symmetrically, all that needs be done to achieve a left-handed putter golf club 10' is the reversal of the hosel 16 wherein the shaft 22 now extends in the opposite club lie angle direction from that of a right-handed embodiment.

Figure 7:
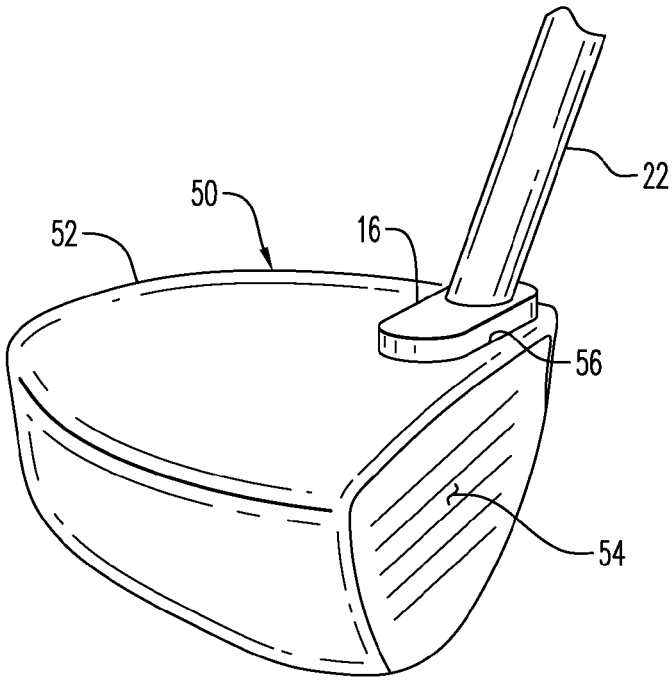
FIG. 7 is an alternate embodiment of the invention depicting a wood club head.

Referring lastly to FIG. 7, the adaptability of the present invention to various club head forms is there depicted. in this embodiment 50, a wood club head 52 is shown attached to the hosel 16 and club shaft 22 within a mating racetrack shaped cavity 56 formed downwardly into the upper surface of the club head 52 immediately adjacent to the ball striking face 54 as previously described. Thus, the invention is easily adaptable to virtually any club head configuration and affords the benefits of interchangeability of lie angle. However, because a golf club wood head is not typically symmetrical, right-handed/left-handed golfer preferences as previously described require individualized club heads.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A golf club comprising:

a club head having an upright golf ball striking face and an elongated upright cavity having a bottom, a length, a width, and a depth and opening upwardly from said club head, said cavity being positioned in close proximity next to said striking face and passing through only one material of said club head;

an elongated club shaft;

a hosel sized for close fitting insertion into, and support within, said cavity, said hosel having a height over an entire length thereof greater than the depth of said cavity wherein, when said hosel is fully inserted into said cavity, all of an upper portion of said hosel is exposed and extending above said cavity;

said hosel having a diagonally upwardly extending cylindrical hole for receiving and lockably supporting a distal lower end of said club shaft, said hole selectively oriented at an acute angle with respect to a bottom surface of said club head which establishes a lie angle of said golf club.

2. A golf club as set forth in claim 1, wherein:

said club head is a putter head.

3. A golf club as set forth in claim 1, wherein:

said club head is a wood or driver head.

4. A golf club as set forth in claim 1, wherein:

said hosel is reversible for a right-handed or left-handed golfer.

5. A golf club as set forth in claim 1, wherein:

a length of said hosel is proximate to a diameter of a golf ball to provide a visual alignment aid.

6. A golf club comprising:

a club head having an upright golf ball striking face and an elongated upright cavity having a closed bottom, a length, a width, and a depth, said cavity opening upwardly from an upper surface of said club head, said cavity being positioned in close proximity next to said striking face and passing through only one material of said club head;

an elongated club shaft;

a hosel sized for close fitting insertion into, and mechanical securement within, said cavity, said hosel having a height over an entire length of said hosel greater than the depth of said cavity wherein, when said hosel is fully inserted into said cavity, an upper portion of said hosel is exposed and extends above said cavity;

said hosel having a rearwardly sloping cylindrical hole for receiving and securing a distal lower end of said club shaft, said hole selectively oriented at an acute angle with respect to a bottom surface of said club head which establishes a lie angle between said bottom surface and a longitudinal axis of said club shaft.

7. A golf club as set forth in claim 6, wherein:

said club head is a putter head.

8. A golf club as set forth in claim 6, wherein:

said club head is a wood or driver head.

9. A golf club as set forth in claim 6, wherein:

said hosel is reversible for a right-handed or left-handed golfer.

10. A golf club as set forth in claim 6, wherein:

a length of said hosel is similar to a diameter of a golf ball to provide a visual alignment aid.

* * * * *